US006434901B1

(12) United States Patent
Schlüter

(10) Patent No.: US 6,434,901 B1
(45) Date of Patent: Aug. 20, 2002

(54) SUPPORT PLATE MADE OF A FOIL-LIKE PLASTIC MATERIAL FOR A PLATE-LINED FLOOR STRUCTURE OR WALL

(75) Inventor: Werner Schlüter, Iserlohn (DE)

(73) Assignee: Schlüter-Systems KG, Iserlohn (DE)

( * ) Notice: Subject to any disclaimer, the term of this patent is extended or adjusted under 35 U.S.C. 154(b) by 0 days.

(21) Appl. No.: 09/673,909

(22) PCT Filed: Apr. 15, 1999

(86) PCT No.: PCT/EP99/02549

§ 371 (c)(1),
(2), (4) Date: Oct. 23, 2000

(87) PCT Pub. No.: WO99/54571

PCT Pub. Date: Oct. 28, 1999

(30) Foreign Application Priority Data

Apr. 22, 1998 (DE) ..... 298 07 258

(51) Int. Cl.[7] ..... E04F 15/00; E04F 17/00

(52) U.S. Cl. ..... 52/302.1; 52/385; 52/389; 52/449; 52/747.11

(58) Field of Search ..... 52/302.1, 385, 52/386, 389, 390, 449, 741.14, 742.16, 746.1, 747.11

(56) References Cited

U.S. PATENT DOCUMENTS

| | | | | |
|---|---|---|---|---|
| 1,965,282 A | * | 7/1934 | Ellithorpe et al. | 52/385 |
| 4,637,184 A | * | 1/1987 | Radtke et al. | 52/220.4 |
| 5,052,161 A | | 10/1991 | Whitacre | |
| 5,489,462 A | * | 2/1996 | Sieber | 52/302.1 X |
| 5,566,522 A | * | 10/1996 | Alander et al. | 52/630 |
| 5,775,039 A | * | 7/1998 | McPherson | 52/169.5 |
| 5,822,937 A | * | 10/1998 | Mahony et al. | 52/386 |
| 6,151,854 A | * | 11/2000 | Gutjahr | 52/385 |

FOREIGN PATENT DOCUMENTS

| | | |
|---|---|---|
| DE | 2650160 | 5/1978 |
| DE | 3045390 | 6/1982 |
| DE | 3701414 | 7/1988 |
| DE | 9114591 | 5/1993 |
| DE | 29602442 | 5/1993 |
| DE | 29622129 | 6/1997 |
| FR | 2544460 | 10/1984 |
| WO | WO82/03099 | 9/1982 |

* cited by examiner

*Primary Examiner*—Carl D. Friedman
*Assistant Examiner*—Brian E. Glessner
(74) *Attorney, Agent, or Firm*—Flanagan & Flanagan; John R. Flanagan

(57) ABSTRACT

The invention relates to a support and/or drainage plate made of a foil-like plastic material, for use with a plate-lined floor structure or a wall so as to create a space between the ground and the surface lining to be applied onto the foil-like plate. The structure of the plate is such that cavities are created by means of, on the one side, projections extending substantially in one direction and, on the other side, raised areas at the same level between which chambers are embodied for receiving a hardening contact medium, such as mortar or adhesive, which forms a contact layer with the surface lining to be applied. According to the invention the structure consists of projections ($N_1$, $N_2$) or ($S_1$, $S_2$) which extend in at least two directions and intersect. The resulting chambers ($M_1$) are delimited in their circumference by the projections ($S_1$, $S_2$), which are open towards the other side of the plate.

8 Claims, 4 Drawing Sheets

SUPPORT PLATE MADE OF A FOIL-LIKE PLASTIC MATERIAL FOR A PLATE-LINED FLOOR STRUCTURE OR WALL

BACKGROUND OF THE INVENTION

The invention relates to a support plate which includes a foil made of a synthetic material and having inner and outer sides and a webbing attached to the inner side of the foil such that the support plate is adapted by the webbing for adhesive attachment to a base of a floor, ceiling or wall structure and the foil provides decoupling of the base and a surface facing applied onto the foil at the outer side of the support plate and wherein on one plate side a net-like textile or a webbing is provided.

The application of facings, in particular ceramic plates, on the interior or the exterior of buildings is frequently problematic. Due to the differing thermal expansions and the stresses entailed therein, cracks can develop in the facing. The detachment of facing plates, due to such states of stress, has been observed.

In particular ceramic plate surfacings are frequently laid applying the so-called thin-bed process, in which a suitable contact adhesive agent is used. Therein difficulties are encountered due to the differing adhesion conditions on the underside of such a plate or on the base. In addition, such problematics is further affected by requirements made of the impermeability of the installation or the provision of drainage capability.

In order to decrement stress differences occurring in such cases of application or in order to decouple the installation, with respect to the occurring stress, from the base, support plates of a foil-like synthetic material have already been proposed. A corresponding plate is known from DE 37 04 414 A1. Through swallowtail-form grooves, open alternatingly to both plate sides, a support plate has therein been proposed which, under pressure and tensile load, can be moved transversely to the extent of these grooves. In order to fasten these plates on the base, a water permeable webbing or a net-like textile is provided on at least one plate side. If such a support plate is fastened on the base and thereon a facing with corresponding contact means is applied, it is subsequently possible to bring about a stress equalization in said direction if it is ensured that the formed grooves do not become completely filled with the contact means, for example an adhesive agent. In order to prevent this filling-in, it has already been proposed to provide such plates on one or on both sides with net-like textiles or webbing, whereby an increased contact capability is also promoted. But such support plates can only be extended or compressed in one preferred direction. Therefore, with such plates the necessary stress decrement is frequently not possible.

The task of the invention comprises proposing a support plate of a foil-like synthetic material for the platefaced floor/ceiling installation or that of a corresponding wall, with which, in an optimizing manner, differing stresses between base and facing, occurring during their corresponding use, are decremented or decoupled.

SUMMARY OF THE INVENTION

This task of the invention is solved with a support plate with the characteristics of claim 1. Such a plate according to the invention of a foil-like synthetic material has an intersecting structuring in which on one plate side intersecting protuberances are formed, which, in each instance, form peripherally closed chambers. These protuberances are formed on the other side in the manner of grooves, such that the other plate side is determined by intersecting groove patterns. As a rule, the plate with the protuberances and the chambers formed therewith will take up the adhesive means or mortar, whereby an intimate bond with the adhesive or mortar layer is generated. In the event of existing stress, in this layer, in turn, at the numerous edges and corners of the protuberances, multitudes of parting gaps can develop serving for the purpose of decrementing stress. Due to the proposed structuring and its material, the foil-like plate itself can be extended or compressed, at least to a satisfactory degree, in both directions of its plane of extension, such that stress differences between the base and the facing can be absorbed.

In the case of the plate of a synthetic foil, structured according to the invention, it is preferably proposed to form the protuberances open to one side with grooves with a substantially rectangular cross section, such that intersecting groove patterns are present. It is therein useful to form these groove patterns in uniform surface distribution disposed perpendicularly to one another.

The protuberances extending at least in two different directions of intersection in each instance form chambers for receiving mortar or adhesive means for fastening the facing placement. Instead of protuberances extending in two different directions, it is also possible to provide three or more. By forming protuberances which are disposed such that they extend in at least two different directions, shearing stress occurring can be taken up according to the protuberances developed in different directions such that the surface facing is effectively decoupled from the base. Due to the intersecting development of the protuberances, in contrast to prior art, the chambers provided for receiving mortar or adhesive means are limited in all circumferential directions and, in each instance, border a protuberance absorbing shearing stress. As a function of the direction in which the shearing stress is occurring, it is absorbed by the protuberances in different proportions as a function of the particular orientation.

The inner width of the discrete grooves of the groove pattern is usefully formed according to that of the other groove pattern such that the compensation capability made possible through the grooves is identical in both directions in view of the shearing forces occurring. For the formation of an undercut projecting into a chamber to bring about a form-fit interlocking of mortar or adhesive means introduced into such a chamber, it can be provided that this undercut is a portion of a protuberance.

Such a protuberance can be formed, for example, by vacuum forming of a synthetic foil. It can therein be provided that the undercut is disposed along the entire periphery along the protuberances delimiting a chamber. It can also be provided that only sections of the bordering protuberances have one undercut each, such as can be realized, for example, in the case of intersecting groove patterns by a protuberance forming in each instance specific sections of an edge of such a chamber. For the development of such an undercut, it is also possible to provide the points of intersection of the intersecting protuberances, for example of the grooves intersecting with one another, wherein such an undercut can be associated partially with the one groove pattern and partially with the other groove pattern.

BRIEF DESCRIPTION OF THE DRAWINGS

In the following the invention will be explained in further detail in conjunction with depicted embodiment examples. Therein show.

DETAILED DESCRIPTION OF THE INVENTION

Figure 4:
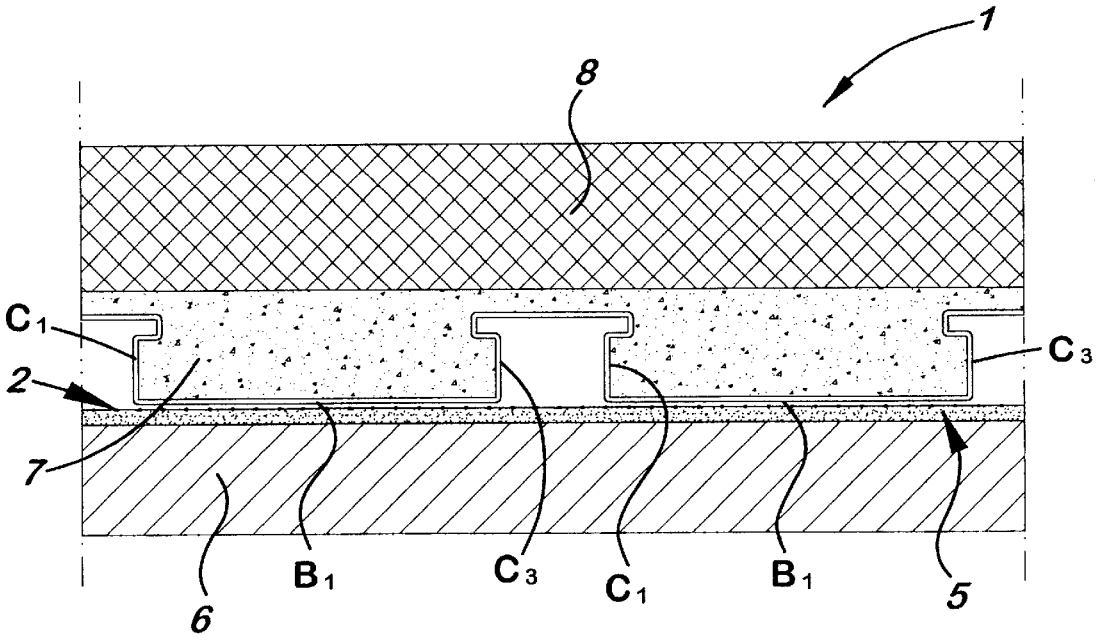

A vacuum-formed support plate 1 of a synthetic foil is structured through two groove patterns extending at right angles with respect to one another, with downwardly open grooves $N_1$, $N_2$. Grooves $N_1$, $N_2$ are open toward an inner side of plate 1, such that the grooves are manifest in the top view in FIG. 1*a* as raised web regions $S_1$ or $S_2$, respectively, which are disposed at an outer side of plate 1 such that the grooves are located behind the raised web regions. The raised web regions $S_1$ extend in the longitudinal direction of the plate 1; the raised web regions $S_2$ extend in the transverse direction; and the raised web regions $S_1$, $S_2$ intersect with one another. Between the grooves and between and offset from the raised web regions, the foil of plate 1 has base web regions $B_1$ which are substantially square in shape, identical in size, larger in size than the raised web regions, and disposed at the inner side of plate 1, and connection web regions $C_1$–$C_4$ which extend at substantially right angles between and interconnect the raised web regions with the base web regions. The base web regions $B_1$ and the connection web regions $C_1$–$C_4$ which surround them form outwardly open mortar chambers $M_1$ which are spaced from one another and located in front of the base web regions of the film. The grooves $N_1$ and $N_2$ intersect at right angles wherein it is provided that the groove pattern-forming grooves $N_1$ and the groove pattern-forming grooves $N_2$ are each spaced apart at an identical spacing from one another such that the raised web sections $S_1$, $S_2$ are substantially rectangular in shape and identical in size with one another. The raised web regions $S_1$, $S_2$ encompass the upwardly open mortar chambers $M_1$ into which mortar 7 is introduced for applying a surface facing 8, for example a tile surfacing. The mortar chambers $M_1$ comprise an undercut $H_1$ disposed completely peripherally about and defined by edge portions of the raised web regions which overhang the mortar chambers, such that portions of mortar 7, comprised by portions of an adhesive cover layer overlying the outer side of the film as seen in FIG. 4, which are introduced into the mortar chambers $M_1$, are retained form-fittingly in them after the mortar 7 has cured and thus is connected with the foil of plate 1. The representation of the undercut $H_1$ of a mortar chamber $M_1$ is also evident in the sectional representation of FIG. 1*b*. The plate 1 further comprises on the inner side thereof a webbing 2, which serves for interlocking the foil of plate 1 in a contact layer applied on a base of either a floor, ceiling or wall structure. The webbing 2 such as a fine-mesh screen fabric serves further to prevent the filling-out of grooves $N_1$ and $N_2$ of the groove patterns which are open toward the inner side of the foil of plate 1. The webbing 2 can therein be fastened through an adhesive connection on the inner side of the plate 1 or it can be pressed into the inner side of the plate 1 when it is still malleable.

The undercut $H_1$ of the plate is formed thereby that the grooves $N_1$, $N_2$ comprise a T-form widening at the top. Such an undercut formation can be accomplished for example through a vacuum forming process. Instead of the formation of the undercut $H_1$ shown in FIGS. 1*a* and 1*b*, it can also be formed approximately in the form of a swallowtail.

Figure 2A:
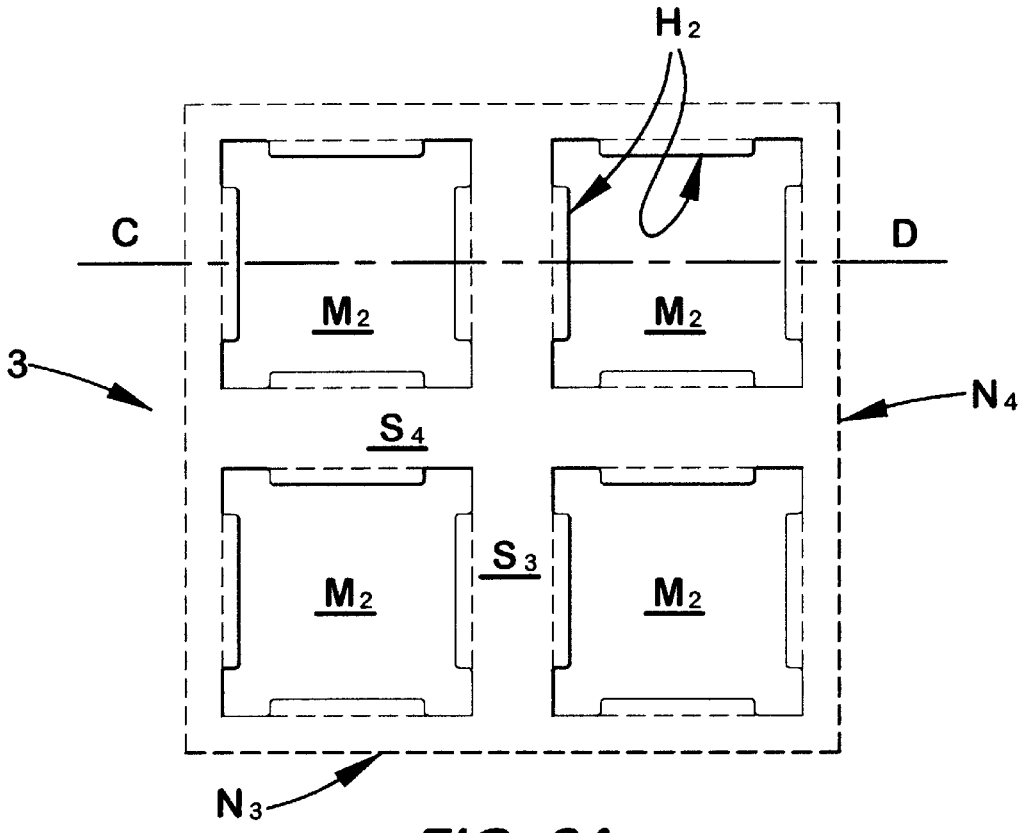
Figure 2B:
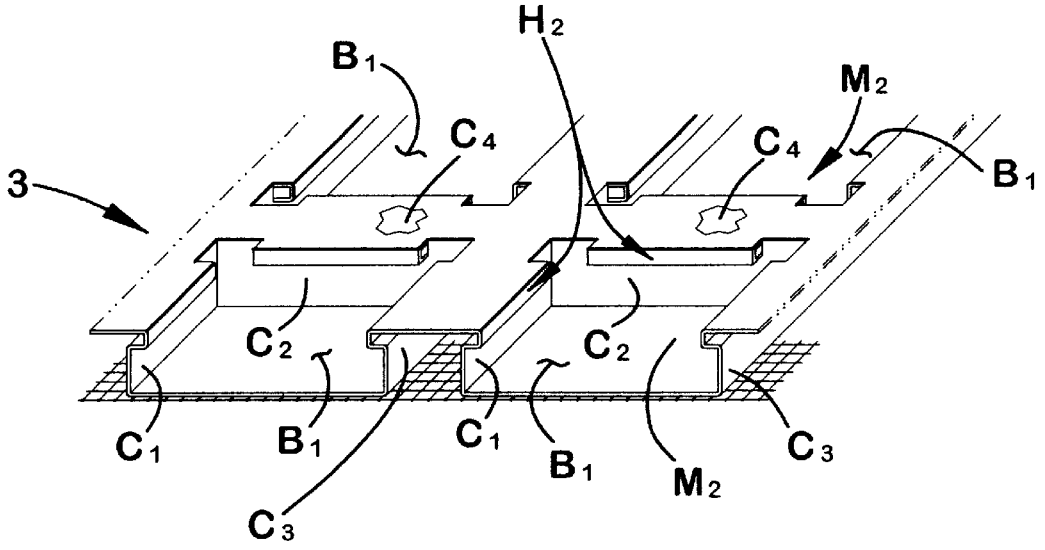

A further support plate 3 of the same type is depicted in FIGS. 2*a* and 2*b*. This plate 3 is structured corresponding to plate 1, however, in contrast to the synthetic foil 1, it comprises mortar chambers $M_2$ which are only undercut in certain regions. The undercuts $H_2$ of this plate 3 are each associated with a groove $N_3$, $N_4$ or a section of web $S_3$ or $S_4$. The undercut regions of webs $S_3$ or $S_4$ are formed by overhangs directed toward the mortar chamber $M_2$, such as illustrated in FIG. 2*b*.

Figure 1A:
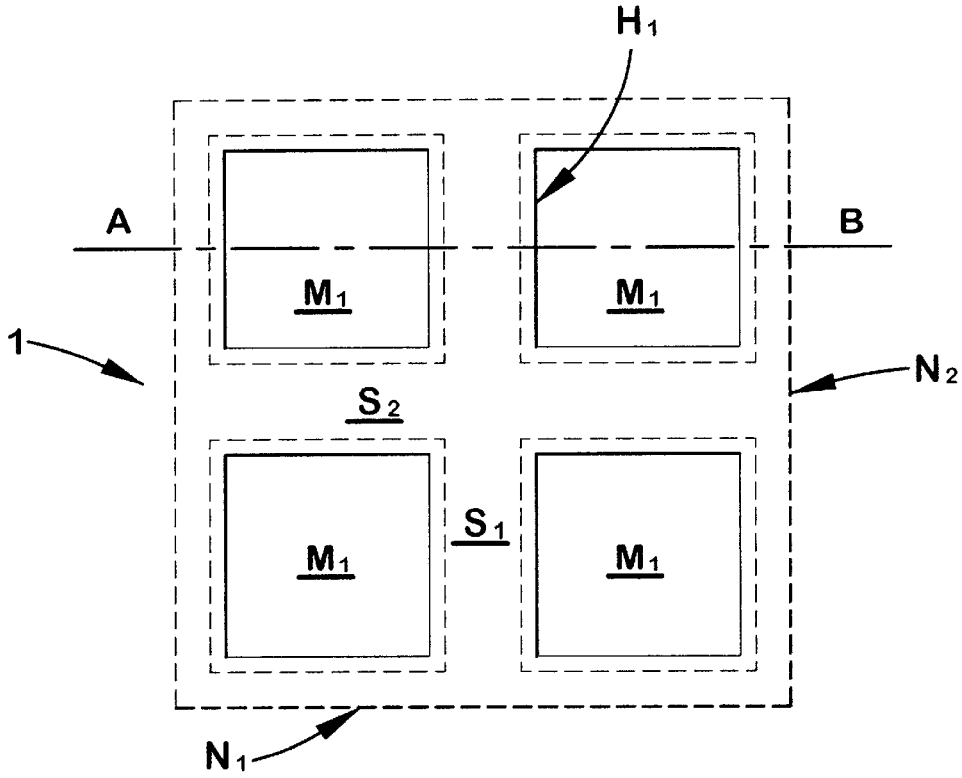
FIG. 1*a* a schematic top view onto a section of a structured synthetic foil as support plate for a building surface facing to obtain stress decoupling, FIG. 1*b* three-dimensional sectional representation through the support plate of FIG. 1*a* along section line A–B, FIG. 2*a* in schematic top view a further structured synthetic foil in section as support plate for a building surface facing to attain stress decoupling, FIG. 2*b* a three-dimensional sectional representation through the synthetic foil of FIG. 2*a* along line C–D, FIG. 3*a* as a section a further support plate for a building surface facing to attain stress decoupling in schematic top view, FIG. 3*b* three-dimensional sectional representation through the plate of FIG. 3*a* along line E–F, FIG. 4 plate of FIG. 1*a* after installation.
Figure 1B:
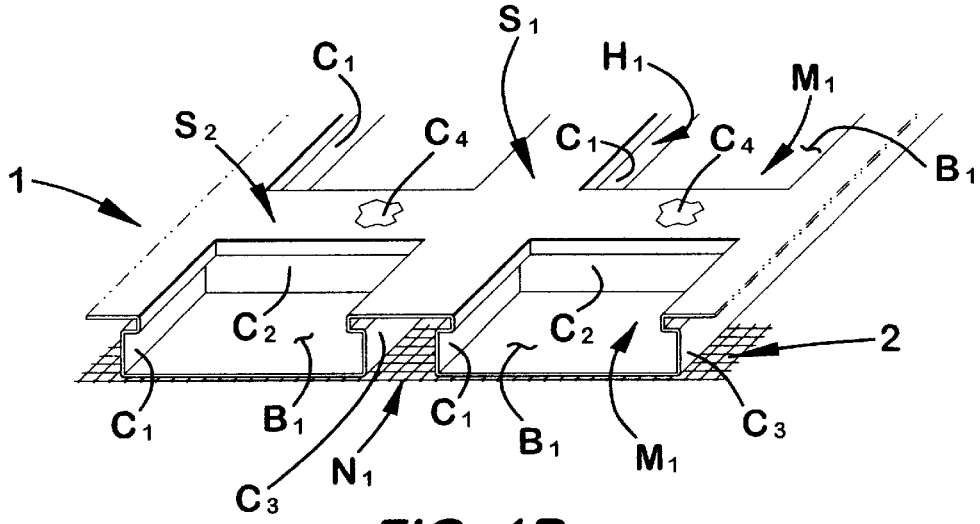
Figure 3A:
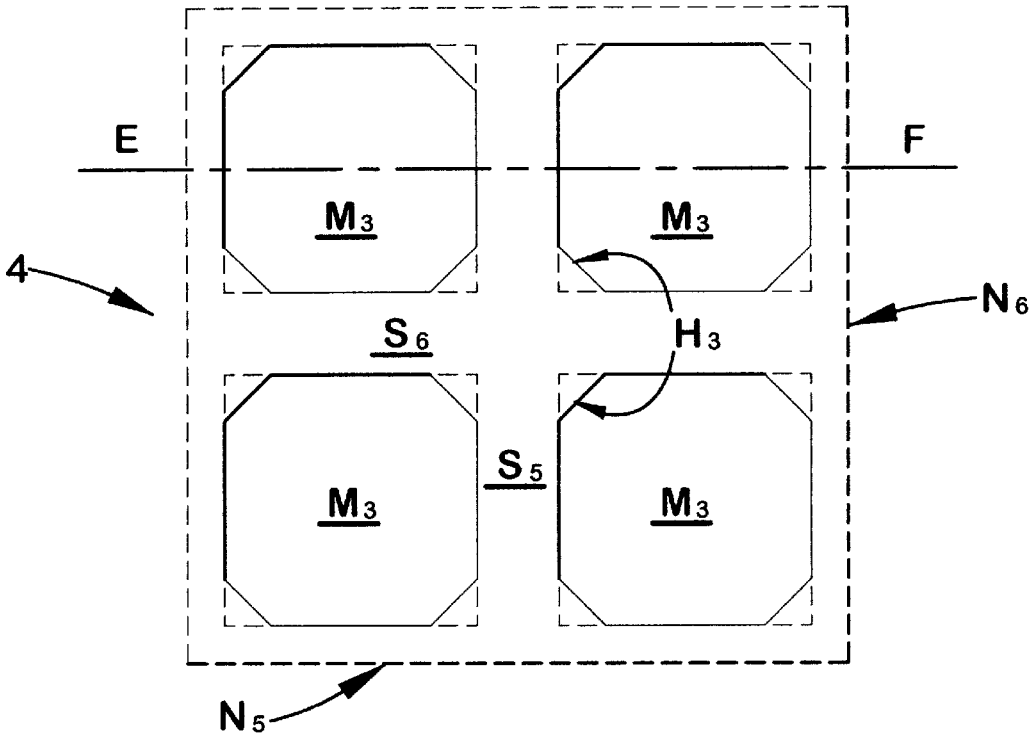
Figure 3B:
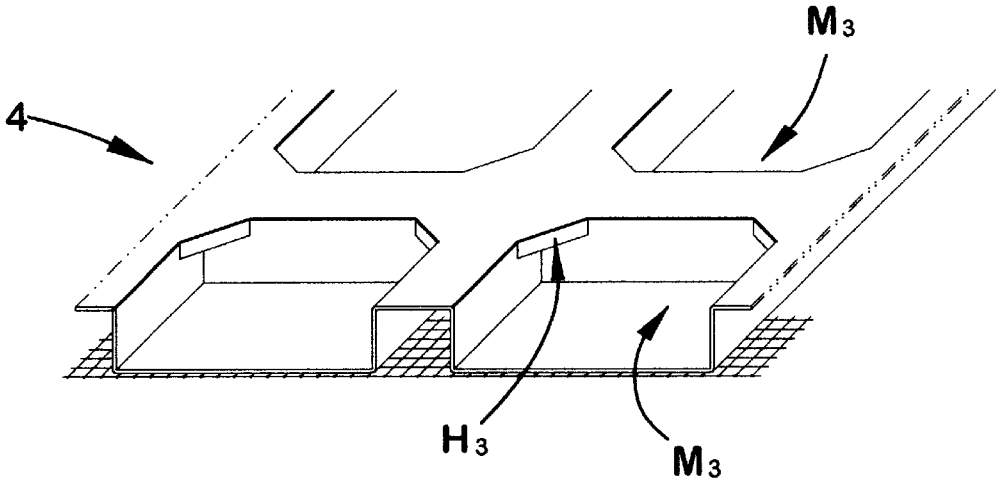

Yet a further support plate 4 is shown in FIGS. 3*a* and 3*b*, which is also built like the support according to FIGS. 1*a* and 1*b* with the difference that webs $S_5$, $S_6$ formed by grooves $N_5$, $N_6$ define undercuts $H_3$ projecting into the mortar chambers $M_3$, which are located in the region of the points of intersection of grooves $N_5$, $N_6$ or of webs $S_5$, $S_6$. The formation of the undercut $H_3$ is evident in particular in FIG. 3*b*.

FIG. 4 shows the plate 1 after it has been installed, such that the plate 1 is fastened on a base 6 by means of an adhesive means or mortar 5. The adhesive means or mortar 5 penetrating into the webbing 2 are sufficiently interlocked in the webbing 2 to anchor the plate 1 on the base 6. After fastening the plate 1 on the base 6, the plate 1 is covered with an adhesive means 7 or mortar, which penetrates into the mortar chamber M and is also introduced behind the undercuts $H_1$. Onto the adhesive means are subsequently placed tiles 8. It is therein provided that the top sides of the web regions $S_1$, $S_2$ are only covered with adhesive means 7 with a low thickness of the layer. When using the tile surfacing as a floor/ceiling, the tiles 8 are braced stilt-like on the side of the base via the adhesive means 7 cured in the mortar chambers M. These mortar stilts are separated by grooves $N_1$, $N_2$. Shearing forces occurring between the base and the surfacing 8 can now be compensated effectively by the synthetic foil 1 due to the disposition of the grooves $N_1$, $N_2$, such that extensive crack formation is avoided.

As was the case in the previously described embodiment examples, the side walls of the grooves can be provided with openings. The groove channels in this case serve also as water removal channels, such that in such a case the support plate used serves not only for the purpose of stress decoupling, but rather also as a drainage plate.

The same-level upper web sides of the web patterns offer the capability of sealed impact connections in different directions of the plane, determined by the upper web side, by means of adhered sealing tapes of corresponding width such that a surface can be sealed contiguously.

If the plate is laid with the webbing 2 facing upwardly, adhesive means or mortar can be applied on the webbing for fastening a surface facing, such as tiles. In this case the groove channels serve also as dewatering channels.

What is claimed is:

1. In combination with a base of a floor, ceiling or wall structure and with an adhesive contact layer and a surface facing adhered on said adhesive contact layer, a support plate comprising:

a foil made of a synthetic sheet material, having spaced apart inner and outer sides, and formed with a plurality of raised web regions disposed at said outer side and extending in longitudinal and transverse directions of said outer side so as to intersect one another and a plurality of base web regions disposed at said inner side offset from and between said raised web regions so as to be spaced from one another by said raised web regions, said raised and base web regions being interconnected together by connection web regions extending between said inner and outer sides of said foil so as to define inwardly open grooves and outwardly open chambers therebetween in a pattern in which said inwardly open grooves intersect one another and are located behind said raised web regions of said foil and said outwardly open chambers are spaced from one another and located in front of said base web regions of said film so as to receive in said outwardly open chambers portions of said adhesive contact layer protruding within said outwardly open chambers to said base web regions of said foil, said raised web regions including edge portions which overhang said outwardly open chambers so as to define undercut portions thereof that retain said portions of said adhesive contact layer therein; and a webbing attached to said inner side of said foil and to said base such that said foil is thereby attached to said base via said webbing and said foil also is attached to said surface facing via said adhesive contact layer so as to permit installation of said surface facing via said foil to said base of floor, ceiling or wall structure while at the same time neither said base nor said adhesive contact layer are not attached to one another because said foil is disposed therebetween and thereby provides a decoupling of differing stresses between said surface facing and said base.

2. The combination of claim 1 wherein said raised web regions are substantially identical in size with one another.

3. The combination of claim 1 wherein each of said raised web regions is substantially rectangular in shape.

4. The combination of claim 1 wherein said base web regions are larger in size than said raised web regions.

5. The combination of claim 1 wherein each of said base web regions is substantially square in shape.

6. The combination of claim 1 wherein said base web regions are substantially identical in size with one another.

7. The combination of claim 1 wherein said connection web regions extend at right angles to said raised and base web regions.

8. The combination of claim 1 wherein said webbing is a fabric webbing.

* * * * *